US006154990A

United States Patent [19]

Cartabbia

[11] Patent Number: 6,154,990

[45] Date of Patent: Dec. 5, 2000

[54] AUTOMATIC IRONING MACHINE FOR IRONING THE NECK AND SHOULDER PORTIONS OF A CLOTH ARTICLE

[76] Inventor: Giovanni Cartabbia, Via Piantada, 9/D, 25036, Palazzolo sull'Oglio, Italy

[21] Appl. No.: 09/297,409

[22] PCT Filed: Mar. 31, 1998

[86] PCT No.: PCT/IT98/00073

§ 371 Date: Apr. 29, 1999

§ 102(e) Date: Apr. 29, 1999

[87] PCT Pub. No.: WO98/44184

PCT Pub. Date: Oct. 8, 1998

[30] Foreign Application Priority Data

Apr. 2, 1997 [IT] Italy ..... MI97A0761

[51] Int. Cl.[7] ..... D06F 71/26

[52] U.S. Cl. ..... 38/35

[58] Field of Search ..... 38/30, 34, 35, 38/37, 40, 41; 223/51.1, 68, 70

[56] References Cited

U.S. PATENT DOCUMENTS

| | | | |
|---|---|---|---|
| 1,865,328 | 6/1932 | Davis | 38/35 |
| 2,465,321 | 3/1949 | Campbell | 38/41 |
| 2,472,656 | 6/1949 | Forse | 38/40 X |
| 2,728,152 | 12/1955 | Campbell | 38/35 |
| 3,583,610 | 6/1971 | Forse | 223/70 X |
| 5,722,572 | 3/1998 | Pessina | 223/52.1 X |

*Primary Examiner*—Ismael Izaguirre
*Attorney, Agent, or Firm*—Hedman, Gibson & Costigan, P.C.

[57] ABSTRACT

An automatic ironing machine for ironing the neck and shoulder portion of a cloth article having a bearing framework defining a fixed bottom shaping element, two supporting arms articulated to the framework and a supporting a plate for a top movable shaping element, the supporting plate being rotatively driven, vertically and transversely with respect to the supporting arms.

8 Claims, 6 Drawing Sheets

AUTOMATIC IRONING MACHINE FOR IRONING THE NECK AND SHOULDER PORTIONS OF A CLOTH ARTICLE

BACKGROUND OF THE INVENTION

The present invention relates to an automatic ironing machine for ironing the neck and shoulder portions of a cloth article.

As is known, for ironing the neck portion of a cloth article in general, and in particular of jackets, are conventionally used ironing apparatus including substantially a bottom framework defining a fixed bottom shaping element, or manikin part, thereon the jacket is applied, and a top movable shaping element, or manikin part, which is driven toward the fixed shaping element in order to properly iron the cloth article.

In these prior ironing machines, the movable shaping element is driven by a rotary movement, which is susceptible to generate a very great horizontal feeding movement for the top shaping element supporting arms, with consequent great dangers for the machine operator.

Further prior solutions provide to support the top shaping element by means adapted to perform vertical movements: however, these vertical movements must be necessarily limited to a comparatively narrow range, in order to prevent the vertical size of the ironing machine from being excessively increased.

Accordingly, the ironing operations are greatly hindered, since the machine operator can not properly see the working surface of the ironing machine.

SUMMARY OF THE INVENTION

Thus, the aim of the present invention is to overcome the above mentioned drawbacks, by providing an automatic ironing machine for ironing neck and shoulder portions of a cloth article in general, which allows to perform a series of operating movements adapted to improve the ironing steps, by movements which are successively controlled and which do not generate any dangerous conditions, while providing the ironing machine with a small size.

Within the scope of the above mentioned aim, a main object of the present invention is to provide such an automatic ironing machine which allows to adjust the ironing length in order to proper iron the lapel portions as well as the inner top and bottom portions of a jacket.

Another object of the present invention is to provide such an automatic ironing machine which is very reliable and safe in operation.

Yet another object of the present invention is to provide such an automatic ironing machine which allows to perfectly iron even neck and shoulder portions of cloth articles difficult to iron, such as the neck, lapel and inner top and bottom portions of a jacket.

In this connection, it should be pointed out that the above mentioned jacket portions are much more difficult to iron as they are made of delicate fabrics requiring that delicate ironing steps be carried out which, on the other hand, could not be easily performed on prior ironing machines.

On the contrary, by using the subject automatic ironing machine, very good results are always obtained, since the top supporting arm of the subject machine has been specifically designed to properly raise and lower a heated plate element supporting the movable shaping element, thereby the movable shaping element is not susceptible to stress or strain undesirably the fabric material of the cloth article to be ironed.

This, in particular, is obtained by providing the top shaping element, during the lowering movement thereof, at the top portion of its path, with a maximum horizontal motion component tending to decrease as the top movable shaping element is lowered to be arranged at a set distance from the cloth article to be ironed.

This feature, which represents a main characteristic of the subject automatic ironing machine, allows to provide safety devices applied to the top shaping element with a very high operating efficiency.

On the contrary, prior safety systems could not operate efficiently on ironing machine including movable arms driven exclusively with rotary movements, which arm, moreover, were dangerous for the operators because of the great horizontal displacements of said arms.

According to a further characteristic of the inventive ironing machine, it is further provided with control devices which have been specifically designed for control the several movement components of the top shaping element.

In particular, as the top shaping element is arrived at a position slightly spaced from the cloth article to be ironed, it is at first subjected to a slight downward vertical translation, in order to iron the neck to the lapel portions of the jacket.

Then, the top shaping element is slightly raised and a pneumatic piston is operated which, through a rod, causes a lever to turn about a pivot point.

This movement is adjusted by a plurality of limit switch elements, of different lengths, which are radially arranged on the surface of a cylinder which is rotatively driven about a shaft, by a lever controlled by the operator.

The above mentioned adjustment is performed in order to properly fit the ironing operations to the length of the inner top and bottom portions of the jacket.

By using the subject ironing machine very good results are obtained, since the top shaping element is transversely displaced with a suitable slanting, thereby allowing to properly iron the inner bottom and top jacket portions without affecting the neck part, since the movable shaping element is at the start raised.

This operation is facilitated by a suitable arrangement of the inner chambers of the shaping elements, through which are performed the vaporizing, sucking and blowing operating cycles.

In this connection it should be pointed out that a critical region of the cloth to be ironed is that between the neck portion and inner top portions of a jacket, substantially corresponding to a lapel of a jacket.

At said surface portion, the top movable shaping element, at the joining region of the two chambers arranged at the jacket lapel, is provided with an inner triangular ridge.

The latter allows, by providing aligned and crossing holes, the underlaying portion to be affected by a fluid flow both during the ironing of the neck and during the ironing of the inner top and bottom portions of the jacket.

During these operations, in particular, the movements of the machine are suitably controlled by linear potentiometers which are vertically and transversely arranged.

According to one aspect of the present invention, the above mentioned aim and objects, as well as yet other objects, which will become more apparent hereinafter, are achieved by an automatic ironing machine for ironing the neck and shoulder portions of a cloth article in general, characterized in that said ironing machine comprises a bearing framework, defining an inner fixed shaping element and that, to said framework, are articulated supporting arms which support a plate in turn supporting a top movable shaping element.

Moreover, driving means are provided for vertically and transversely driving said supporting plate with respect to said supporting arms.

BRIEF DESCRIPTION OF THE DRAWINGS

Further characteristics and advantages of the present invention will become more apparent hereinafter from the following disclosure of a preferred, though not exclusive, embodiment of an automatic ironing machine for ironing the neck and shoulder portions of a cloth article in general, which is illustrated, by way of a merely indicative, but not limitative, example, in the accompanying drawings, where.

DESCRIPTION OF THE PREFERRED EMBODIMENTS

Figure 1:
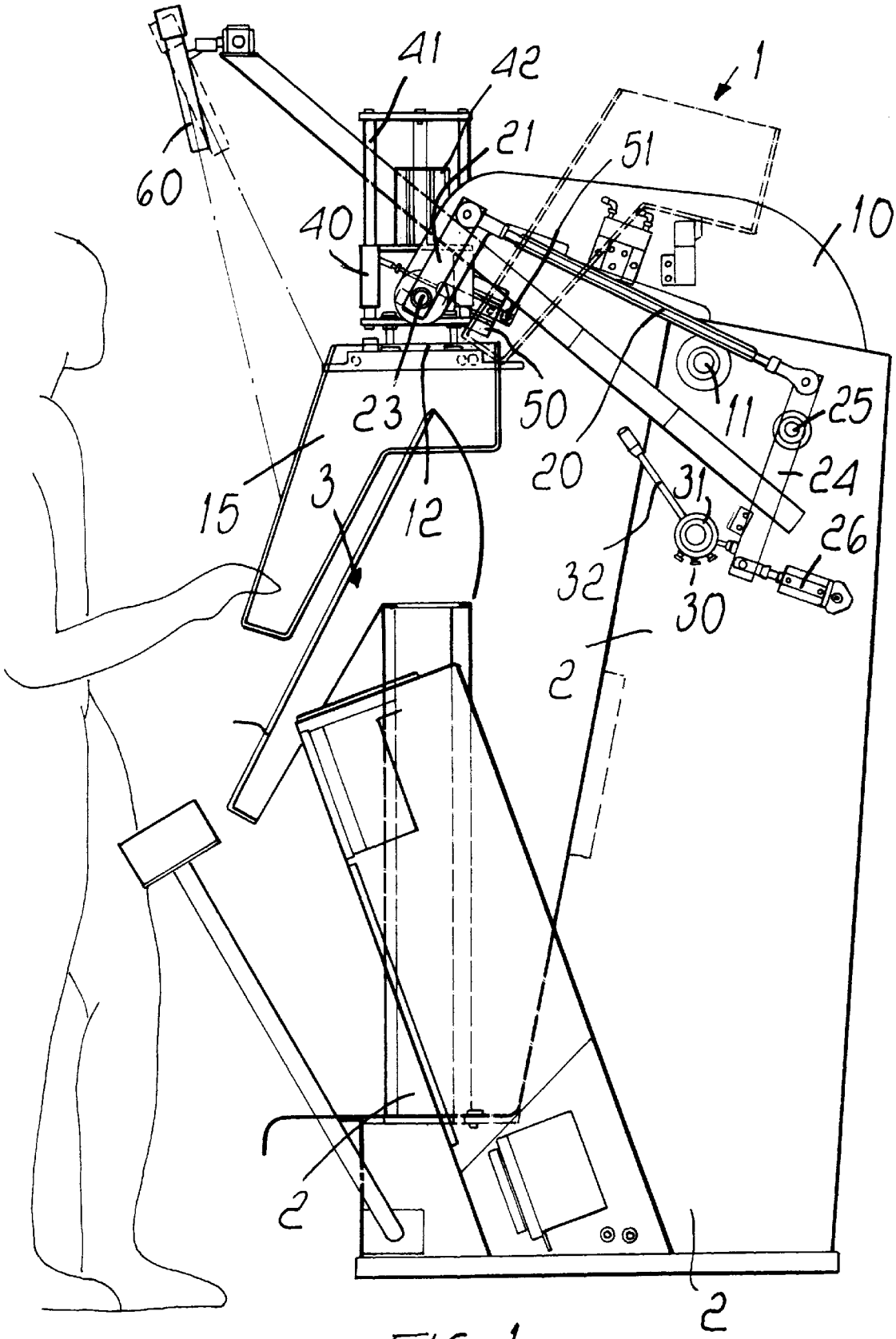
FIG. 1 is a schematic side elevation view illustrating the ironing machine according to the present invention.
Figure 2:
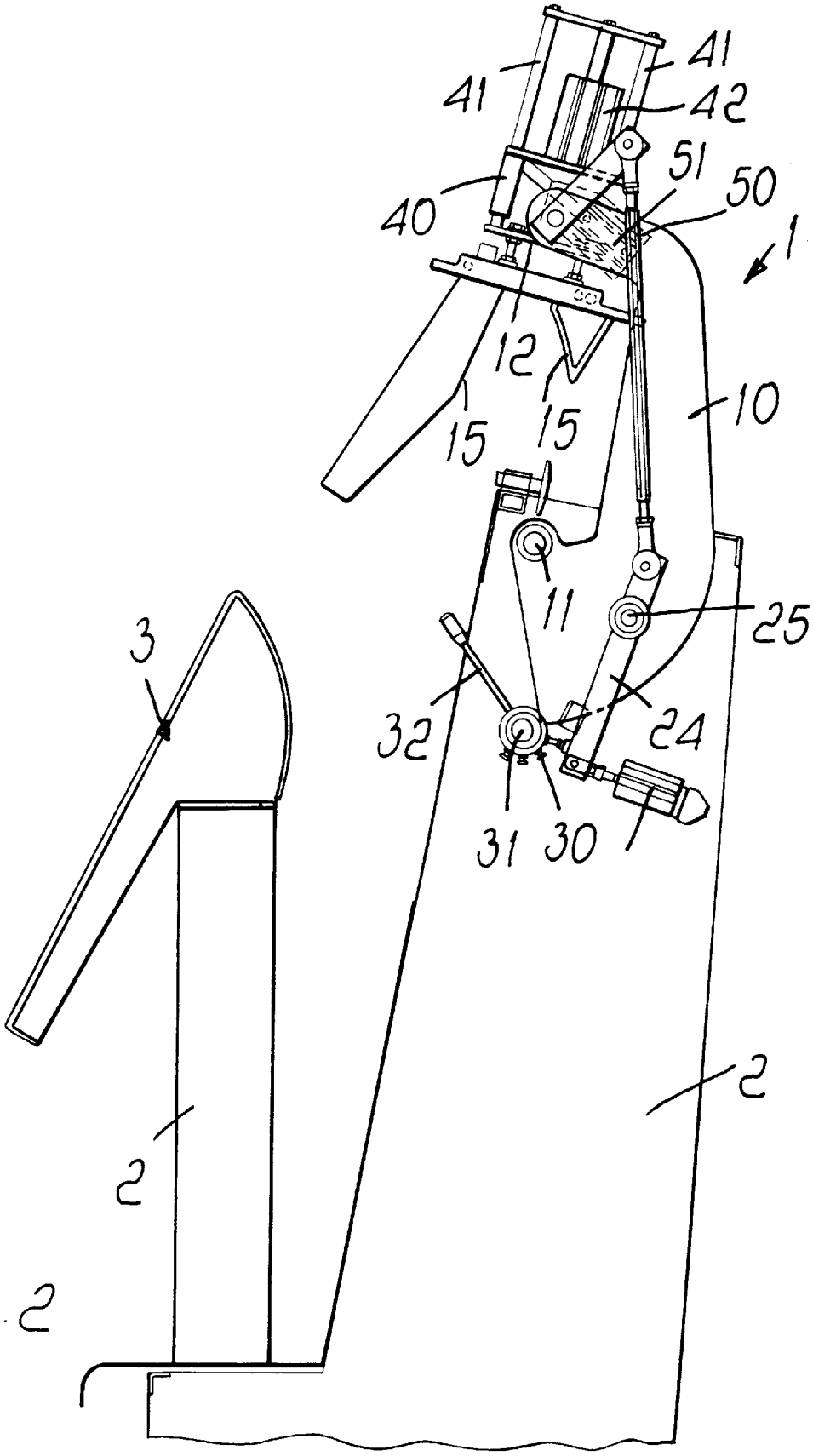
FIG. 2 illustrates the subject automatic ironing machine in which the top movable shaping element or manikin part is arranged in a raised position.
Figure 3:
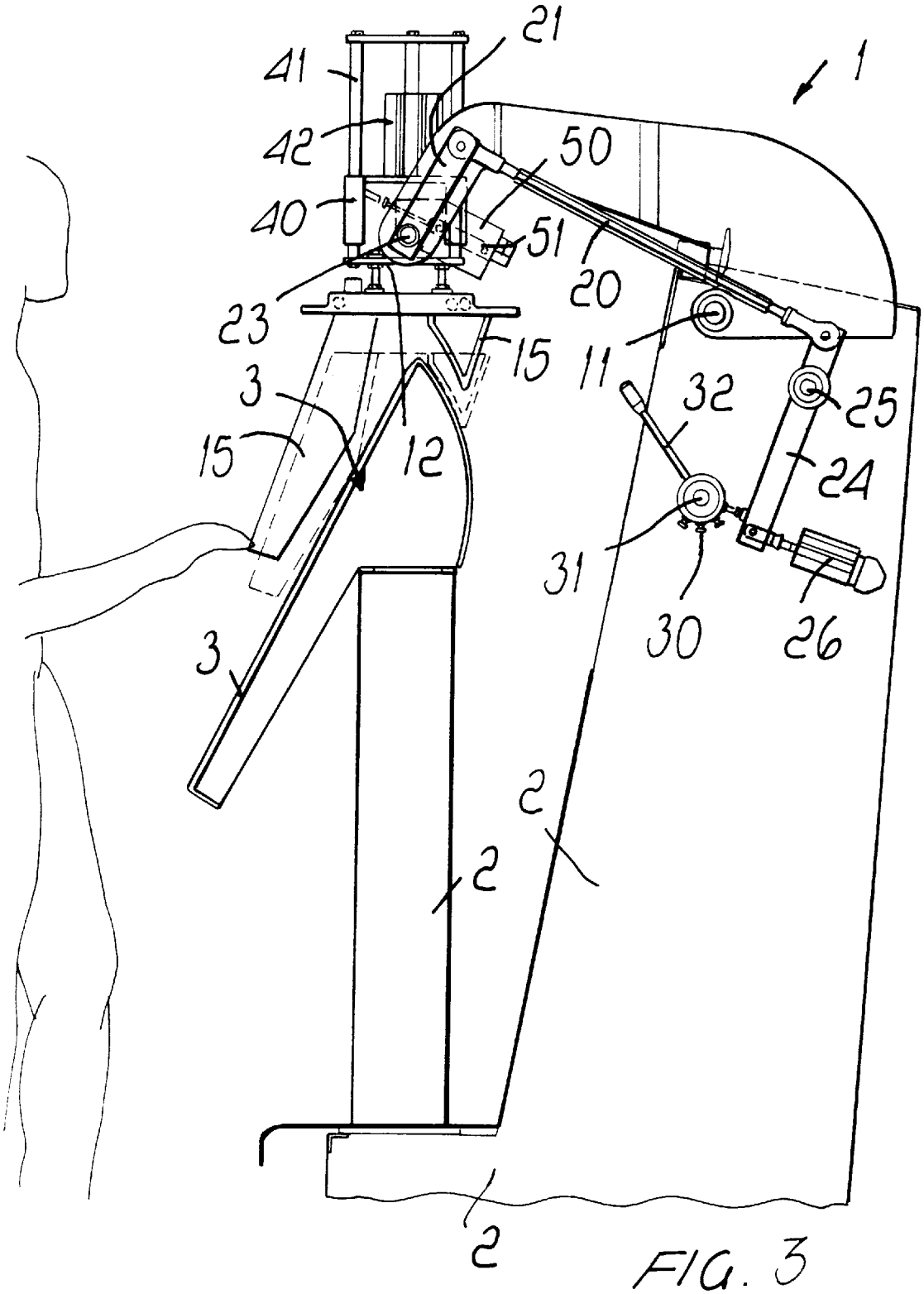
FIG. 3 illustrates the subject automatic ironing machine with the top movable shaping element in a working condition.
Figure 4:
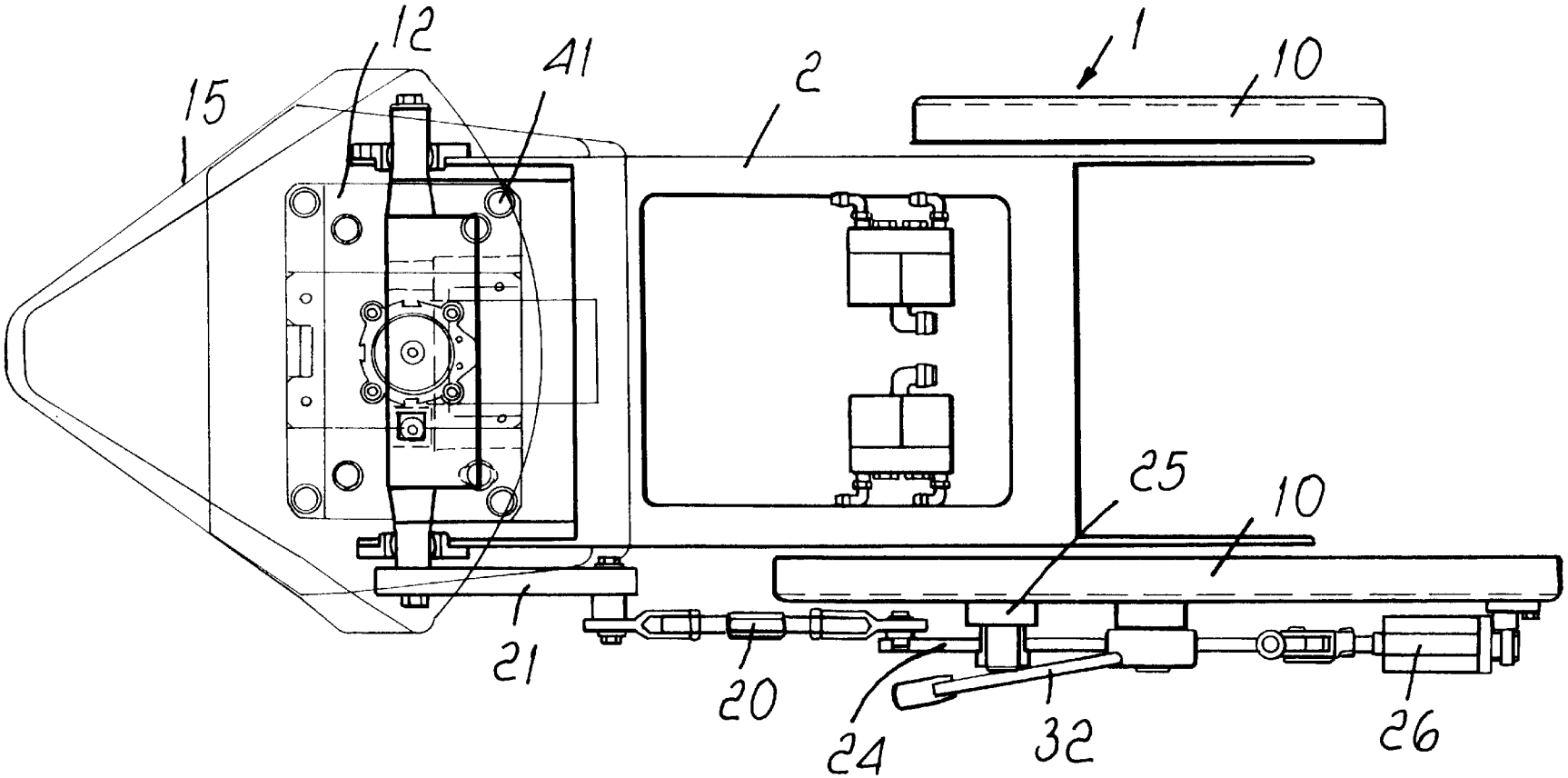
FIG. 4 is a top plan view of the subject automatic ironing machine.
Figure 5:
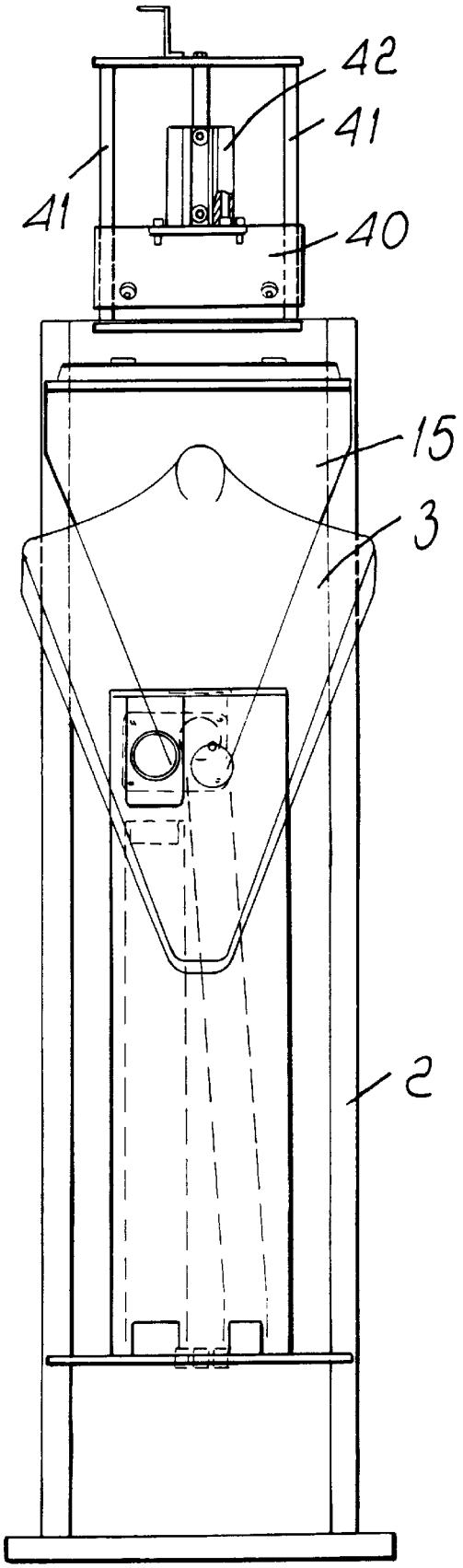
FIG. 5 is a front elevation view of the subject automatic ironing machine.
Figure 6:
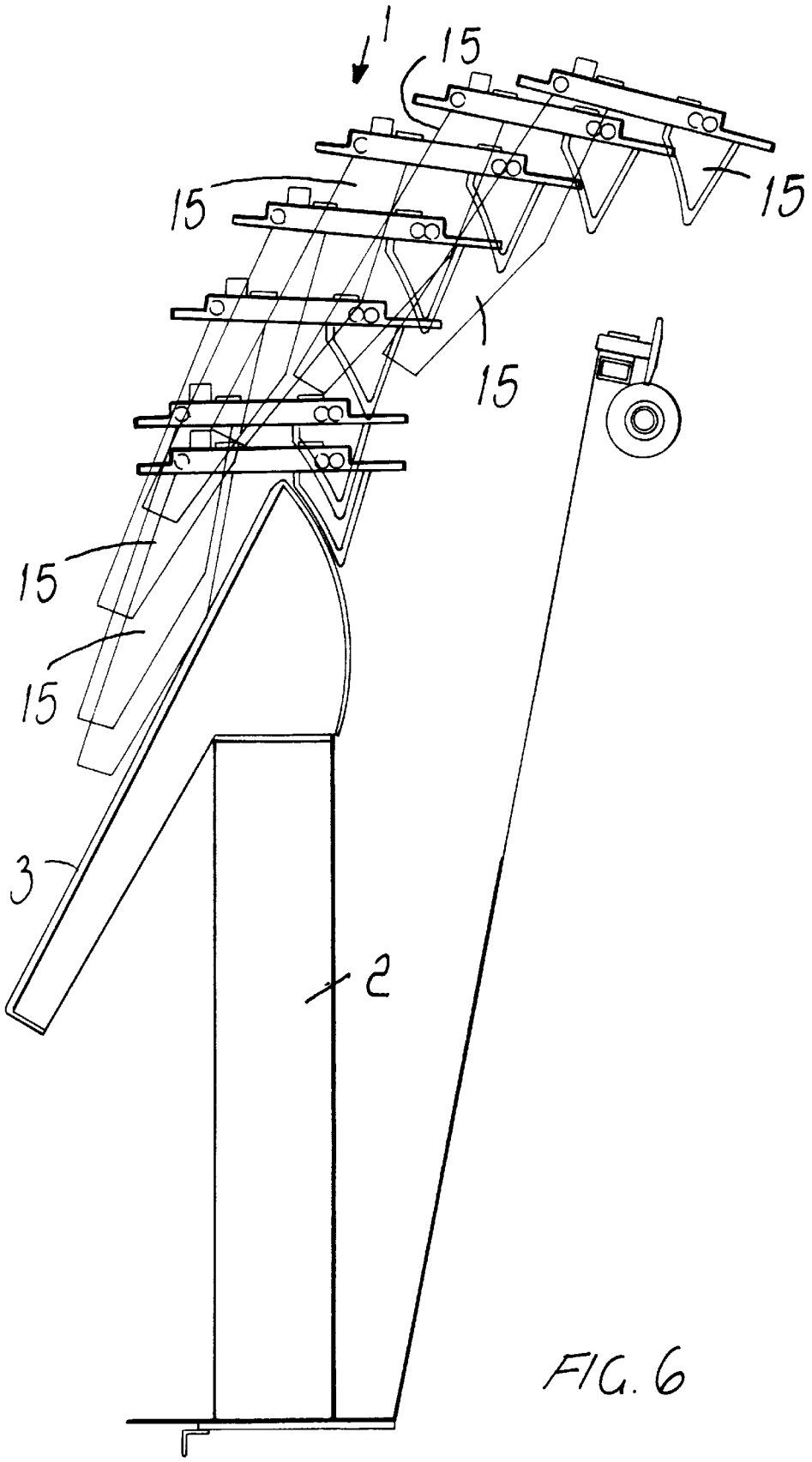
FIG. 6 is a schematic view illustrating a series of possible feeding or approaching movements performed by the top movable shaping element.

With reference to the number references of the above mentioned figures, the subject automatic ironing machine, for ironing the neck and shoulder portions of a cloth article in general, and which has been generally indicated by the reference number 1, comprises a bearing framework 2, which supports a fixed bottom shaping element or manikin part 3, thereon is properly arranged a cloth article to be ironed.

To the bearing framework 2 a supporting arm 10 is pivoted, said supporting arm 10 being adapted to turn about a horizontal rotary axis, indicated generally by the reference number 11.

At the other end portion of said arm, which has preferably a C-shape configuration, a supporting plate 12 supporting a top movable shaping element, generally indicated by the reference number 15, is coupled.

The main feature of the invention is that said plate 12, which is operatively connected to heating means, can perform several movements and, in particular, a rotary movement obtained by the provision of an adjustable tie-rod 20 which, at one end thereof, is pivoted to a lever 21 in turn connected to said plate 12 at the transversal or cross pivoting axis 23.

The adjusting tie-rod 20 is connected, at the other end thereof, to a swinging lever 24, which is pivoted at a middle portion 25 thereof and, at the other end thereof is coupled to a driving cylinder 26 provided for swingably driving said lever 24, in cooperation with adjustable abutments 30, provided on a cylinder 31 supported by the sidewalls of the bearing framework and driven by a lever 32 which, can be engaged by the operator.

The plate 12 is coupled to vertical driving means, including a guide frame 40, in which vertical column 41 slide in order to support said plate 12, driven by a pneumatic piston 42.

Moreover, transversal or cross driving means are provided, said transversal driving means including transversal or cross guides 50, which are coupled to a transversal or cross driving piston 51, allowing to provide a cross displacement.

The machine comprises furthermore a plurality of control devices for controlling several movement components of the top movable shaping element 15.

More specifically, as the top movable shaping element is arrived at a position slightly spaced from the cloth article to be ironed, at first it is slightly vertically downwardly displaced to properly iron the neck up to the lapel of the jacket.

Then, the top shaping element is slightly raised, and a pneumatic cylinder 26 is actuated which, by operating the swinging rod 24, through the adjustable tie-rod 20, will cause the lever 21 to turn about the cross shaft 23.

This movement will be adjusted by limit switch elements 30, having different lengths, which are radially arranged on the surface of the cylinder 31 and which are properly located by the operator controlled lever 32.

These series of operating steps will allow to properly adjust the ironing length for properly ironing the lapel and inner top end bottom portions of the jackets.

To that end, the top movable shaping element will be transversely driven by the piston 51, with a set slanting, thereby allowing to properly iron the inner top and bottom portions of the jacket, without affecting the neck portion, since the movable shaping element has been arranged at a starting raised position.

This operation will be facilitated by a suitable arrangement of the inner chambers of the shaping elements, by means of which chambers are performed the vaporizing, sucking and blowing steps.

As stated, a critical region of the cloth article to be ironed, is that between the neck portion and the top inner portion, corresponding to the lapels of a jacket.

At said surface portion, the top movable shaping element 15, at the joining zone of the two chambers arranged at the jacket lapels, is provided with an inner triangular ridge, allowing to affect both the neck portion and inner top portion by steam jets, ejected through the crossing aligned holes.

The driving movements of the machine are controlled by linear potentiometers which are vertically and transversely arranged.

From the above disclosure it should be apparent that the invention fully achieves the intended aim and objects.

In particular, an automatic ironing machine has been provided which allows to perform a programmed series of movements specifically designed for facilitating the operation of the machine and which, moreover, greatly increase the safety of said machine.

Moreover, it is also possible to provide spot elements, indicated by the reference number 60, marking reference points for properly locating the cloth article on the shaping or manikin element therefor.

The invention as disclosed is susceptible to several modifications and variations, all of which will come within the scope of the inventive idea.

Moreover, all of the details can be replaced by other technically equivalent elements.

In practicing the invention, the used materials, provided that they are compatible to the intended application, as well as the contingent size and shapes, can be any, according to requirements.

What is claimed is:

1. An automatic ironing machine for ironing neck and shoulder portions of a cloth article having a top portion, a bottom portion, a neck portion and label portions, said automatic ironing machine comprising a bearing framework defining a fixed bottom shaping element and supporting arms articulated to said framework for supporting a supporting plate which supports a top movable shaping element, said supporting plate being provided with vertical guides, driving means for rotatively, vertically and transversely driving said supporting plate with respect to said supporting arms, said driving means being provided with an adjustable tie-rod having a first end and a second end, said tie rod being coupled at said first end to a lever connected to said supporting plate at a pivot point of said supporting arms and, at said second end, to a swinging lever coupled to a driving cylinder, wherein said machine comprises limit switch elements coupled to a cylinder controlled by a lever, said limit switch elements being adapted to cooperate with said swinging lever.

2. An automatic ironing machine, according to claim 1, wherein said driving means comprises vertically extending guides, which slide in vertical column elements for supporting said plate.

3. An automatic ironing machine, according to claim 1, wherein said driving means comprises a transversal cylinder coupled to a transversal guide operating on said vertical guides of said supporting plate.

4. An automatic ironing machine, according to claim 1, wherein said top movable shaping element, is arranged at a position slightly spaced from said cloth article, performs a slight vertical downward translation so as to iron said neck portion up to said lapel portions of said cloth article.

5. An automatic ironing machine, according to claim 1, wherein said top movable shaping element is slightly raised to actuate a pneumatic cylinder driving a swinging rod, through an adjustable tie-rod, thereby causing a lever to turn about a transversal shaft, said movement being adjusted by limit switch elements, of different length, arranged radially on a surface of a cylinder and which are located by a lever controlled by an operator.

6. An automatic ironing machine, according to claim 1, wherein said top movable shaping element is adapted to be transversely driven by a driving piston set at a slant.

7. An automatic ironing machine, according to claim 1, wherein said top movable shaping element, is provided with an inner triangular ridge.

8. An automatic ironing machine, according to claim 1, wherein said machine comprises marking spots for marking reference points for properly locating said cloth article on said bottom and top shaping elements.

* * * * *